US012022947B2

(12) United States Patent
Cheng

(10) Patent No.: US 12,022,947 B2
(45) Date of Patent: Jul. 2, 2024

(54) OVER-THE-DOOR ORGANIZER

(71) Applicant: Changsha Yuepu Children's Products Co., Ltd., Changsha (CN)

(72) Inventor: Hao Cheng, Changsha (CN)

(73) Assignee: CHANGSHA YUEPU CHILDREN'S PRODUCTS CO., LTD., Changsha (CN)

( * ) Notice: Subject to any disclaimer, the term of this patent is extended or adjusted under 35 U.S.C. 154(b) by 0 days.

(21) Appl. No.: 18/089,602

(22) Filed: Dec. 28, 2022

(65) Prior Publication Data

US 2024/0138567 A1 May 2, 2024

(30) Foreign Application Priority Data

Oct. 26, 2022 (CN) ..... 202222843769.2

(51) Int. Cl.
*A47B 95/00* (2006.01)
*A47B 96/16* (2006.01)

(52) U.S. Cl.
CPC ..... *A47B 95/008* (2013.01); *A47B 96/16* (2013.01)

(58) Field of Classification Search
CPC ..... A47B 95/008; A47B 96/16; A47K 10/10; A47G 25/0614
See application file for complete search history.

(56) References Cited

U.S. PATENT DOCUMENTS 4,138,019 A * 2/1979 Smith ..... A47F 5/0807 248/220.31
4,352,480 A * 10/1982 Gathright ..... G10G 5/00 84/327
5,272,991 A * 12/1993 Carrigan, Jr. ..... A47B 96/067 211/188
5,477,967 A * 12/1995 Voorhees ..... A47F 7/147 248/214
5,485,932 A * 1/1996 Romm ..... H02G 3/28 248/214
5,547,088 A * 8/1996 Belokin ..... A47B 96/06 211/106
5,894,940 A * 4/1999 Gusdorf ..... A47B 57/425 211/35
6,089,387 A * 7/2000 Varfolomeeva ..... A47F 5/0031 211/90.03

(Continued)

*Primary Examiner* — Ko H Chan
(74) *Attorney, Agent, or Firm* — Bayramoglu Law Offices LLC

(57) ABSTRACT

An over-the-door organizer includes a first mounting rack, a plurality of second mounting racks, a plurality of storage baskets, and a plurality of hanging plates. The plurality of hanging plates are connected to the first mounting rack, and the first mounting rack is hung on a door through the plurality of hanging plates. The plurality of second mounting racks are detachably connected one by one to form a whole and then detachably connected to the first mounting rack. Each of the first mounting rack and the second mounting racks is provided with a plurality of pairs of mounting holes at an interval. Each of the storage baskets is provided with a pair of hooks, and the pair of hooks are detachably connected to any pair of mounting holes. The storage baskets are hung by inserting the hooks into the mounting holes at different positions, and the spacing between each two adjacent storage baskets is adjustable.

19 Claims, 4 Drawing Sheets

(56) References Cited

U.S. PATENT DOCUMENTS

| | | | | |
|---|---|---|---|---|
| 6,349,516 | B1 * | 2/2002 | Powell | E04B 2/7437 52/239 |
| 6,540,093 | B1 * | 4/2003 | Shumway | A47B 57/404 108/147.11 |
| 6,663,201 | B2 * | 12/2003 | Herron, III | A47B 96/028 312/245 |
| 7,261,214 | B2 * | 8/2007 | Wagner | A47F 5/0823 211/187 |
| 7,967,268 | B2 * | 6/2011 | Herron, III | A47B 57/42 108/106 |
| 8,016,135 | B2 * | 9/2011 | Price | A47F 5/00 211/DIG. 1 |
| 9,211,023 | B1 * | 12/2015 | Weiss | A47G 25/0614 |
| 9,736,992 | B1 * | 8/2017 | Barry | A01G 5/04 |
| 10,368,639 | B1 * | 8/2019 | Lai | A47B 95/00 |
| 10,512,325 | B2 * | 12/2019 | Mitchell | A47G 29/00 |
| D904,127 | S * | 12/2020 | Song | D7/600.1 |
| 2004/0118791 | A1 * | 6/2004 | Rimback | A47F 7/08 211/119.004 |

* cited by examiner

OVER-THE-DOOR ORGANIZER

CROSS REFERENCE TO THE RELATED APPLICATIONS

This application is based upon and claims priority to Chinese Patent Application No. 202222843769.2, filed on Oct. 26, 2022, the entire contents of which are incorporated herein by reference.

TECHNICAL FIELD

The present disclosure relates to the technical field of organizers and, in particular, to an over-the-door organizer.

BACKGROUND

With the continuous improvement of people's living standards, there are increasing items of daily use appearing around the home. People are often annoyed about how to organize these items to access them easily and keep the house tidy. In this context, various organizers for different items came into being. In the existing organizer, the storage baskets are welded on the shelf with a fixed spacing, which makes it impossible to place relatively high items into the storage basket smoothly, thereby resulting in poor flexibility. In addition, because the organizer is not detachable and has a large packaging volume, it is inconvenient for packaging and transportation.

SUMMARY

I. Technical Problem to be Solved

In view of this, the present disclosure provides an over-the-door organizer, which solves the technical problems of poor flexibility and the large packaging volume of the existing over-the-door organizer.

II. Technical Solution

To achieve the objective, the over-the-door organizer of the present disclosure includes a first mounting rack, a plurality of second mounting racks, a plurality of storage baskets, and a plurality of hanging plates.

The plurality of hanging plates are connected to the first mounting rack, and the first mounting rack is hung on a door through the plurality of hanging plates.

The plurality of second mounting racks are detachably connected one by one to form a whole and then detachably connected to the first mounting rack.

Each of the first mounting rack and the second mounting racks is provided with a plurality of pairs of mounting holes at an interval. Each of the storage baskets is provided with a pair of hooks, and the pair of hooks are detachably connected to any pair of mounting holes.

Optionally, each of the hanging plates includes a connecting plate and a limit plate. A first end of the connecting plate is connected to the first mounting rack, and a second end of the connecting plate is perpendicularly connected to the first end of the limit plate. The limit plate is opposite from the first mounting rack.

Optionally, each of the hanging plates further includes a limit bar. The limit plate is provided with a threaded hole. The limit bar is provided with an external thread, and the limit bar is threaded with the threaded hole.

A first end of the limit bar is provided with a knurl wheel, and a second end of the limit bar is provided with a pressure piece.

Optionally, each of the connecting plate and the pressure piece is provided with a buffer pad.

Optionally, each of the first mounting rack and the second mounting racks includes a first vertical tube, a second vertical tube, and a horizontal tube.

The first vertical tube and the second vertical tube are parallel to each other. A first end of the horizontal tube is perpendicularly connected to the first vertical tube, and a second end of the horizontal tube is perpendicularly connected to the second vertical tube.

The first vertical tubes of the first mounting rack and the second mounting rack as well as first vertical tubes of each two adjacent second mounting racks are connected through a first connecting tube. The second vertical tubes of the first mounting rack and the second mounting rack as well as second vertical tubes of each two adjacent second mounting racks are connected through a second connecting tube.

Optionally, adjacent ends of two adjacent first vertical tubes are sleeved on the first connecting tube, and the first connecting tube is connected to the first vertical tubes through a bolt.

Adjacent ends of two adjacent second vertical tubes are sleeved on the second connecting tube, and the second connecting tube is connected to the second vertical tubes through a bolt.

Optionally, the first vertical tube and the second vertical tube are square tubes. A first side of each of the first vertical tube and the second vertical tube is provided with a plurality of mounting holes at the interval. The mounting holes on the first vertical tube and the mounting holes on the second vertical tube are arranged in pairs in one-to-one correspondence.

The over-the-door organizer includes two hanging plates, and the two hanging plates are respectively connected to the first vertical tube and the second vertical tube of the first mounting rack.

Optionally, the mounting holes are slotted holes.

Optionally, the over-the-door organizer further includes a plurality of suction cups, and the plurality of suction cups are arranged on the second mounting rack.

Optionally, each of the storage baskets includes a bottom plate and a side plate that are connected to each other, and the hooks are arranged on the side plate.

III. Beneficial Effects

The plurality of second mounting racks are detachably connected one by one, and the second mounting rack at the topmost side is detachably connected to the first mounting rack hung on the door. The over-the-door organizer is in a disassembled state during packaging and transportation to reduce the packaging volume of the over-the-door organizer and improve the convenience for transportation of the over-the-door organizer. The storage baskets are hung by inserting the hooks into the mounting holes at different positions, and the spacing between each two adjacent storage baskets is adjustable to match items of different lengths, thereby effectively improving the flexibility and further improving the convenience for transportation of the over-the-door organizer.

REFERENCE NUMERALS

Figure 1:
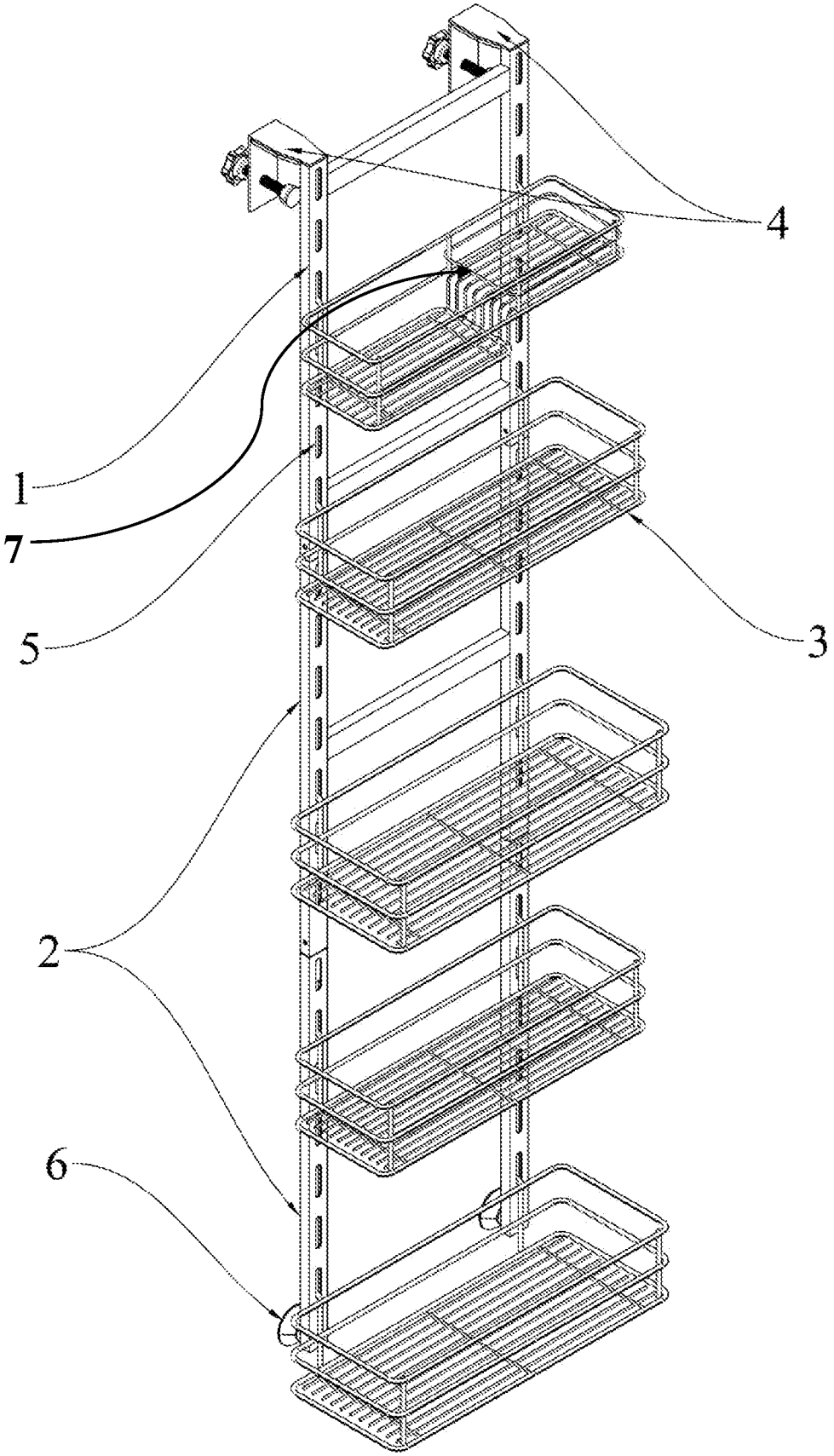
FIG. 1 is a stereoscopic view of an over-the-door organizer from a first angle according to the present disclosure.

1. first mounting rack; 11. first vertical tube; 12. second vertical tube; and 13. horizontal tube;
2. second mounting rack;
3. storage basket; 31. bottom mesh; and 32. side mesh;
4. hanging plate; 41. connecting plate; 42. limit plate; 43. limit bar; 44. knurl wheel; and 45. pressure piece;
5. mounting hole;
6. suction cup; and
7. horizontal bar.

DETAILED DESCRIPTION OF THE EMBODIMENTS

To better explain the present disclosure and facilitate understanding, the present disclosure is described in detail below by referring to the drawings and specific implementations. The terms such as "upper" and "lower" mentioned herein are based on the orientations shown in FIG. 1.

Although the drawings show the exemplary embodiments of the present disclosure, it should be understood that the present disclosure may be implemented in various forms and should not be limited to the embodiments set forth herein. On the contrary, these embodiments are provided such that the present disclosure is more fully understood and fully conveys the scope of the present disclosure to those skilled in the art.

Figure 2:
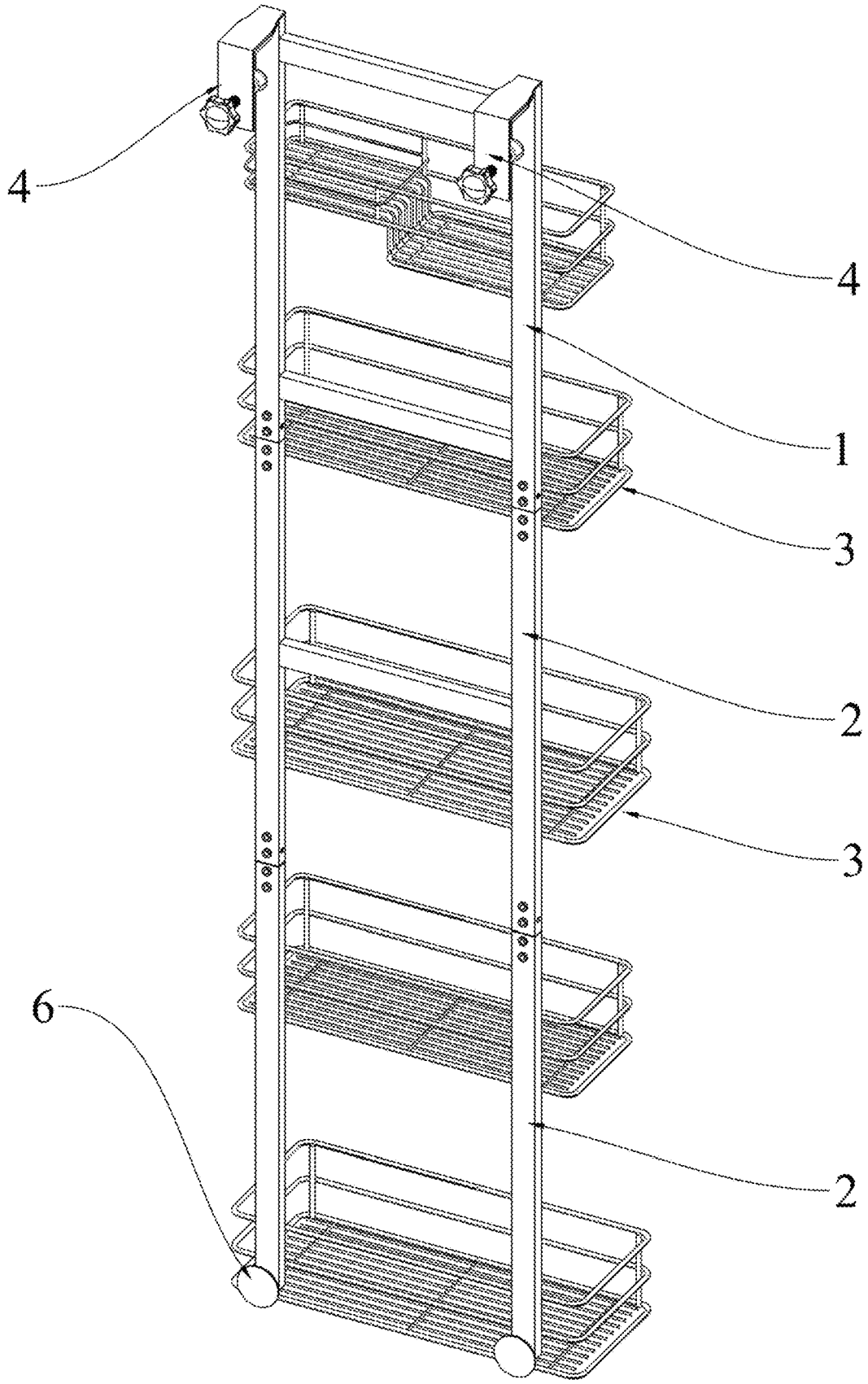
FIG. 2 is a stereoscopic view of the over-the-door organizer from a second angle according to the present disclosure.

As shown in FIGS. 1 and 2, the present disclosure provides an over-the-door organizer, which is hung on the back of a partition door or a bathroom door for placing items of daily use. The over-the-door organizer includes first mounting rack 1, a plurality of second mounting racks 2, a plurality of storage baskets 3, and a plurality of hanging plates 4. The plurality of hanging plates 4 are connected to the first mounting rack 1 and are hung on an upper edge of a door, such that the first mounting rack 1 is hung on the door through the plurality of hanging plates 4. The plurality of second mounting racks 2 are detachably connected one by one, and the topmost second mounting rack 2 is detachably connected to the first mounting rack 1 hung on the door. The over-the-door organizer is in a disassembled state during packaging and transportation to reduce the packaging volume of the over-the-door organizer and improve the convenience for transportation of the over-the-door organizer. Each of the first mounting rack 1 and the second mounting racks 2 is provided with a plurality of pairs of mounting holes 5 at an interval. When the over-the-door organizer is hung on the door, the central axes of each pair of mounting holes 5 are located in the same horizontal plane. Each of the storage baskets 3 is provided with a pair of hooks, which can be detachably connected to any pair of mounting holes 5. The storage baskets 3 are hung by inserting the hooks into the mounting holes 5 at different positions, and the spacing between each two adjacent storage baskets 3 is adjustable to match items of different lengths, thereby effectively improving the flexibility and further improving convenience for transportation of the over-the-door organizer.

Figure 3:
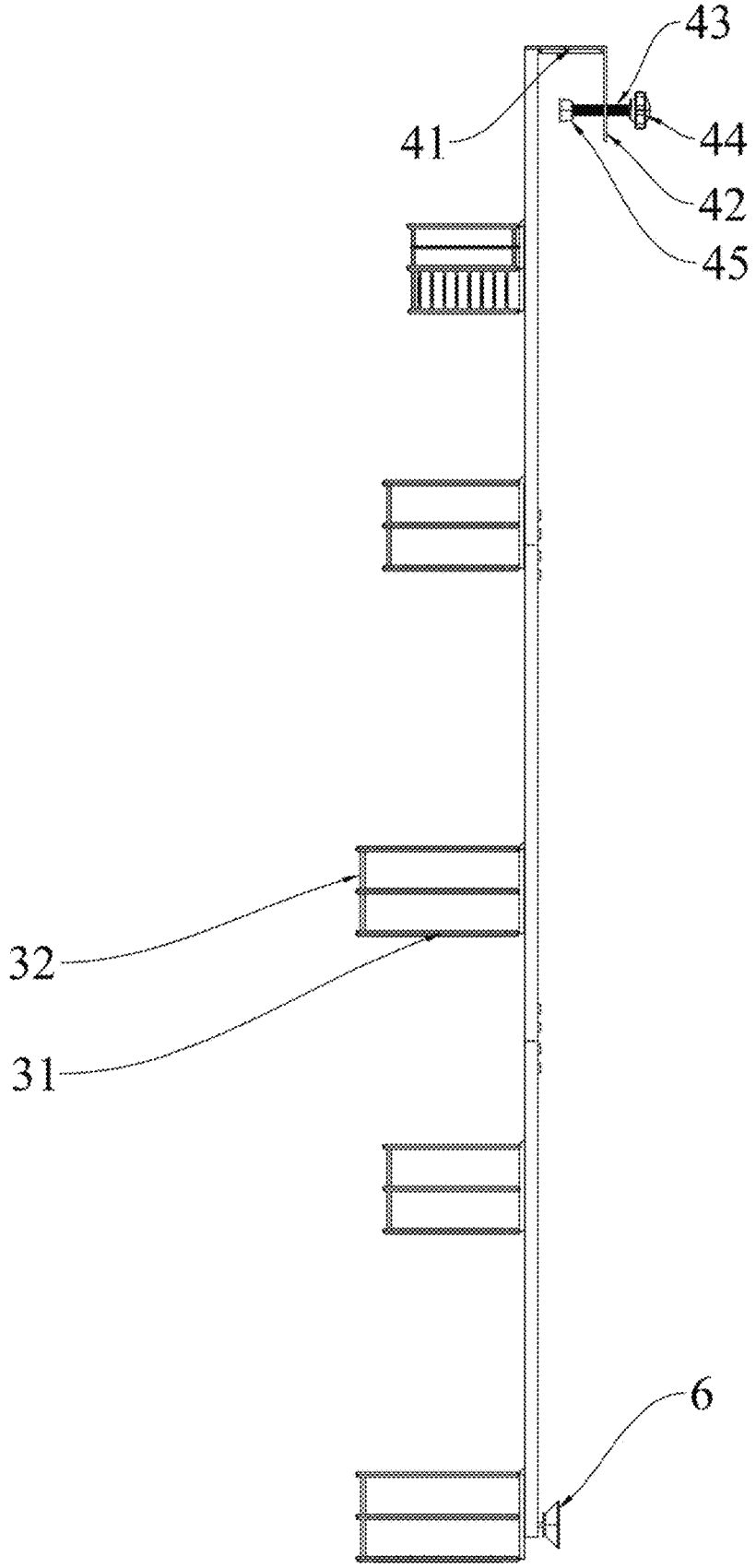
FIG. 3 is a side view of the over-the-door organizer according to the present disclosure.

Further, as shown in FIG. 3, each of the hanging plates 4 includes connecting plate 41 and limit plate 42. The lower surfaces of the connecting plates 41 of the plurality of hanging plates 4 are on the same level. A first end of the connecting plate 41 is connected to the first mounting rack 1, and a second end of the connecting plate 41 is perpendicularly connected to the first end of the limit plate 42. The limit plate 42 is opposite from the first mounting rack 1. Therefore, the hanging plate 4 has a square structure with an opening at the lower side, such that the hanging plate 4 can be directly hung on the upper edge of the door, improving the convenience of mounting. Each of the hanging plates 4 further includes limit bar 43. The limit plate 42 is provided with a threaded hole, and the limit bar 43 is provided with an external thread. The limit bar 43 is threaded with the threaded hole, and the limit bar 43 is vertical to the limit plate 42. When the hanging plate 4 is hung on the door, the lower surface of the connecting plate 41 is abutted against the upper edge of the door, and the first mounting rack 1 is abutted against the back plate of the door. The limit bar 43 is rotated to adjust the distance between pressure piece 45 on the second end of the limit bar 43 and the first mounting rack 1, such that the pressure piece 45 is abutted against the front plate of the door. The front plate and the back plate of the door are opposite from each other. The hanging plates are adaptable to doors of different thicknesses and can firmly abut the first mounting rack 1 against the door, thereby effectively improving the stability and flexibility of mounting.

As shown in FIG. 3, after the limit bar 43 is connected to the threaded hole, a first end of the limit bar 43 is arranged at a knurl wheel 44 to facilitate the rotation of the limit plate 42. The pressure piece 45 is arranged at the second end of the limit bar 43 to increase the contact area between the limit bar 43 and the door plate and further improve the mounting stability. The lower surface of the connecting plate 41 and the side of the pressure piece 45 facing the door are provided with buffer pads to prevent the connecting plate 41 and the pressure piece 45 from damaging the door surface.

Figure 4:
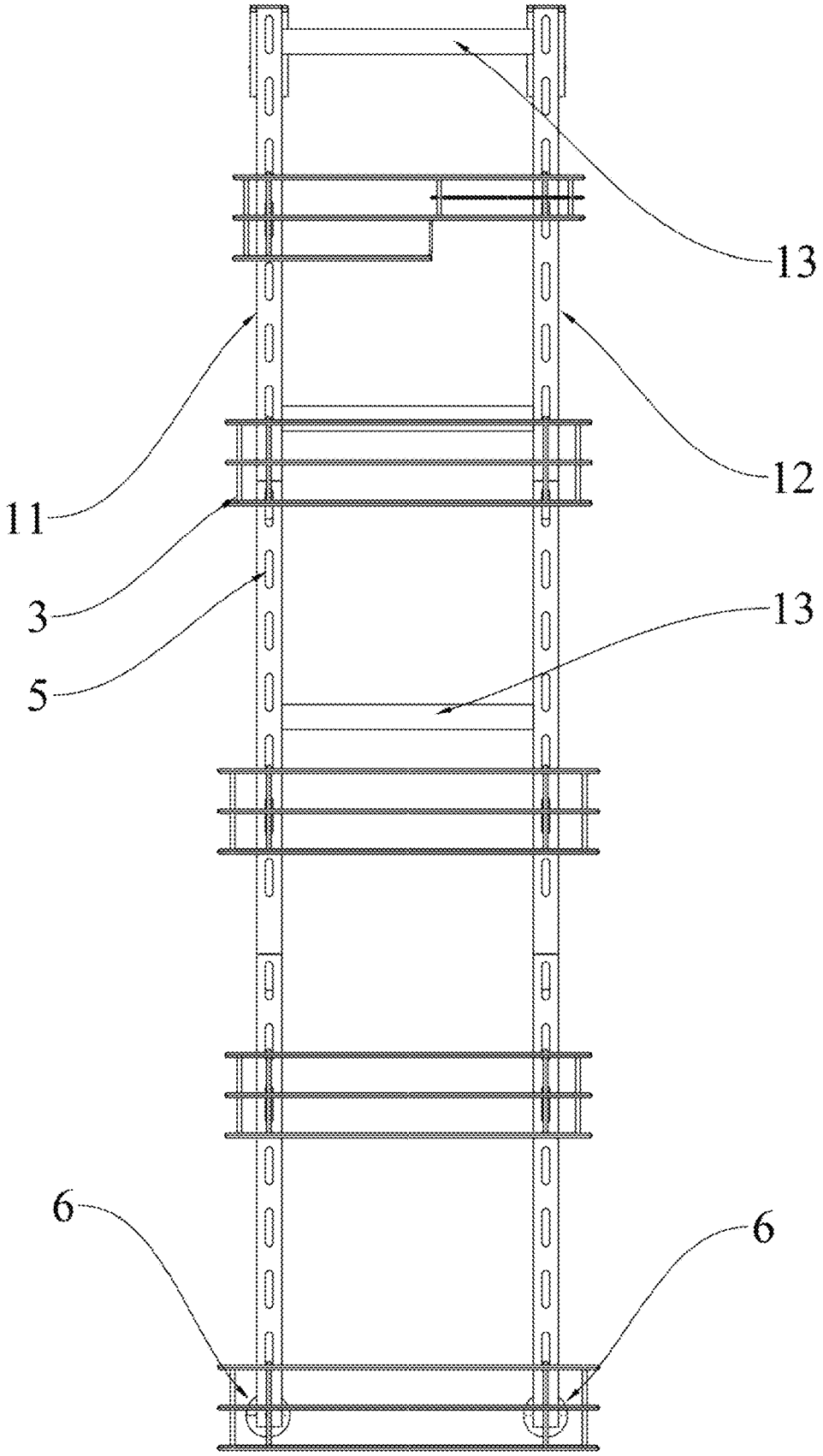
FIG. 4 is a front view of the over-the-door organizer according to the present disclosure.

As shown in FIGS. 3 and 4, each of the first mounting rack 1 and the second mounting racks 2 includes first vertical tube 11, second vertical tube 12, and horizontal tube 13. The first vertical tube 11 and the second vertical tube 12 are hollow tubes that have the same length and are parallel to each other. A first end of the horizontal tube 13 is perpendicularly connected to the first vertical tube 11, and a second end of the horizontal tube 13 is perpendicularly connected to the second vertical tube 12. The connection can be either a welded or bolted connection. The adjacent ends of first vertical tubes 11 of the first mounting rack 1 and the second mounting rack 2 as well as the adjacent ends of first vertical tubes 11 of each two adjacent second mounting racks 2 are detachably connected through a first connecting tube. The adjacent ends of second vertical tubes 12 of the first mounting rack 1 and the second mounting rack 2 as well as the adjacent ends of second vertical tubes 12 of each two adjacent second mounting racks 2 are detachably connected through a second connecting tube.

Specifically, as shown in FIG. 3, the adjacent ends of the two adjacent first vertical tubes 11 are sleeved on the first connecting tube, and the first connecting tube is connected to the first vertical tubes 11 through a bolt to prevent the first vertical tubes 11 from slipping out of the first connecting tube. The adjacent ends of the two adjacent second vertical tubes 12 are sleeved on the second connecting tube, and the second connecting tube is connected to the second vertical tubes 12 through a bolt to prevent the second vertical tube 12 from slipping out of the second connecting tube. This design improves the bearing capacity of the over-the-door organizer.

Preferably, as shown in FIG. 1, the first vertical tube 11 and the second vertical tube 12 are square tubes. The first side of each of the first vertical tube 11 and the second vertical tube 12 is provided with a plurality of mounting holes 5 at the interval and a second side abutting against the back plate of the door. The first side and the second side are opposite from each other. The mounting holes 5 on the first vertical tube 11 and the mounting holes 5 on the second vertical tube 12 are arranged in pairs in one-to-one correspondence. Central axes of each pair of mounting holes 5 are located in the same horizontal plane. In a preferred implementation, the over-the-door organizer is provided with two hanging plates 4. The two hanging plates 4 are respectively connected to the first vertical tube 11 and the second vertical tube 12 of the first mounting rack 1. The first mounting rack 1 is hung through the two hanging plates 4. The first mounting rack 1 will not swing in the vertical plane after being hung, and the overall weight of the over-the-door organizer is reduced.

As shown in FIG. 4, the mounting holes 5 are slotted holes, which are convenient for the disassembly and assembly of the hooks.

As shown in FIGS. 1 to 4, the over-the-door organizer further includes a plurality of suction cups 6, and the plurality of suction cups 6 are arranged on the second mounting rack 2. Preferably, the suction cups 6 are mounted on the second mounting rack 2 away from the first mounting rack 1. The suction cups 6 are arranged on the first vertical tube 11 and the second vertical tube 12 of the second mounting rack 2 and are opposite from the back plate of the door. After the over-the-door organizer is hung on the door, the suction cups 6 are attracted to the back plate of the door to prevent the lower end of the over-the-door organizer from swinging, thereby further improving the mounting stability of the over-the-door organizer.

As shown in FIGS. 1 to 4, each of the storage baskets 3 includes bottom mesh 31 and side mesh 32 that are connected to each other. The shape of the storage baskets 3 can be customized according to the needs of users and is not limited herein. The hooks are arranged on the side mesh 32. The hooks are inserted into the mounting holes 5 to realize the mounting of the storage basket 3, which is convenient for the disassembly and assembly of the storage basket. The bottom mesh 31 and the side mesh 32 may be made of a wire mesh, which is convenient for water leakage when used in a bathroom. A storage basket may include a horizontal bar 7 extending from a front of the storage basket to a back of the storage basket (e.g., across a middle of a basket).

The plurality of second mounting racks 2 are detachably connected one by one, and the second mounting rack 2 at the topmost side is detachably connected to the first mounting rack 1 hung on the door. The over-the-door organizer is in a disassembled state during packaging and transportation to reduce the packaging volume of the over-the-door organizer and improve the convenience for transportation of the over-the-door organizer. The storage baskets 3 are hung by inserting the hooks into the mounting holes 5 at different positions, and the spacing between each two adjacent storage baskets 3 is adjustable to match items of different lengths, thereby effectively improving the flexibility and further improving convenience for transportation of the over-the-door organizer. When the hanging plate 4 is hung on the door, the lower surface of the connecting plate 41 is abutted against the upper edge of the door, and the first mounting rack 1 is abutted against the back plate of the door. The limit bar 43 is rotated to adjust the distance between pressure piece 45 on the second end of the limit bar 43 and the first mounting rack 1, such that the pressure piece 45 is abutted against the front plate of the door. The front plate and the back plate of the door are opposite from each other. The hanging plates are adaptable to doors of different thicknesses and can firmly abut the first mounting rack 1 against the door, thereby effectively improving the stability and flexibility of mounting. The lower surface of the connecting plate 41 and the side of the pressure piece 45 facing the door are provided with buffer pads to prevent the connecting plate 41 and the pressure piece 45 from damaging the door surface.

It should be understood that in the description of the present disclosure, terms such as "first" and "second" are used merely for a descriptive purpose and should not be construed as indicating or implying relative importance or implicitly indicating the number of technical features. Thus, features defined with "first" and "second" may explicitly or implicitly include one or more of the features. In the description of the present disclosure, the term "a plurality of" means two or more unless otherwise specifically defined.

In the present disclosure, unless otherwise clearly specified, the terms "installation", "interconnection", "connection" and "fixation" are intended to be understood in a broad sense. For example, the "connection" may be a fixed connection, removable connection or integral connection; or it may be a mechanical connection or electrical connection; or it may be a direct connection or indirect connection using a medium; or it may be a communication or interaction between two elements. Those of ordinary skill in the art may arrive at any of the specific meanings of the above terms in the present disclosure based on specific situations disclosed.

In the present disclosure, unless otherwise explicitly stipulated, "a first feature is above or below a second feature" may indicate that "the first and second features are in direct contact" or "the first and second features are in indirect contact through an intermediate feature". In addition, when it is described that the first feature is "over", "above" and "on" the second feature, it indicates that the first feature is directly or obliquely above the second feature or that an altitude of the first feature is higher than that of the second feature. When it is described that a first feature is "under", "below" or "beneath" a second feature, it indicates that the first feature is directly or obliquely under the second feature or that the first feature is lower than the second feature.

In the description of this specification, the description with reference to the terms such as "one embodiment", "some embodiments", "embodiments", "an example", "a specific example" and "some examples" indicates that the specific features, structures, materials, or characteristics described with reference to the embodiment or example are included in at least one embodiment or example of the present disclosure. In this specification, schematic representation of the above terms is not necessarily directed to the same embodiment or example. Moreover, the specific features, structures, materials, or characteristics described may be combined in a suitable manner in any one or more embodiments or examples. In addition, those skilled in the art may combine different embodiments or examples described in this specification and characteristics of the different embodiments or examples without mutual contradiction.

Although the embodiments of the present disclosure have been described above, it should be understood that the above embodiments are exemplary and may not be construed as limitations to the present disclosure. A person of ordinary skill in the art may make various changes, modifications, replacements, and variations in the above embodiments within the scope of the present disclosure.

What is claimed is:

1. An over-the-door organizer, comprising a first mounting rack, a plurality of second mounting racks, a plurality of storage baskets, and a plurality of hanging plates, wherein the plurality of hanging plates are connected to the first mounting rack, and the first mounting rack is hung on a door through the plurality of hanging plates;

the plurality of second mounting racks are detachably connected one by one to form a whole and then detachably connected to the first mounting rack; and each of the first mounting rack and the second mounting racks is provided with a plurality of pairs of mounting holes at an interval; and each of the plurality of storage baskets is provided with a pair of hooks, and the pair of hooks are detachably connected to any pair of mounting holes, wherein at least one of the plurality of storage baskets comprises a storage basket being substantially rectangular, the storage basket having bottoms at two different basket depths, a first bottom at first level, the first bottom extending lengthwise from a first short end of the storage basket towards a second short end of the storage basket, and a second bottom at a second level higher than the first level, the second bottom extending lengthwise from the second short end of the storage basket until a meeting point between the first bottom and the second bottom, wherein the meeting point is a vertical plane connecting the first bottom and the second bottom;

wherein the at least one of the plurality of storage baskets further comprises a bar extending widthwise from a front of the storage basket to a back of the storage basket, the bar extending substantially horizontally at a level above a top of the vertical plane at the meeting point and below a top of the storage basket.

2. The over-the-door organizer according to claim 1, wherein each of the plurality of hanging plates comprises a connecting plate and a limit plate; a first end of the connecting plate is connected to the first mounting rack, and a second end of the connecting plate is perpendicularly connected to a first end of the limit plate; and the limit plate is opposite from the first mounting rack.

3. The over-the-door organizer according to claim 2, wherein each of the plurality of hanging plates further comprises a limit bar; the limit plate is provided with a threaded hole, and the limit bar is provided with an external thread; and the limit bar is threaded with the threaded hole; and a first end of the limit bar is provided with a knurl wheel, and a second end of the limit bar is provided with a pressure piece.

4. The over-the-door organizer according to claim 3, wherein each of the connecting plate and the pressure piece is provided with a buffer pad.

5. The over-the-door organizer according to claim 1, wherein each of the first mounting rack and the plurality of second mounting racks comprises a first vertical tube, a second vertical tube, and a horizontal tube;

the first vertical tube and the second vertical tube are parallel to each other;

a first end of the horizontal tube is perpendicularly connected to the first vertical tube, and a second end of the horizontal tube is perpendicularly connected to the second vertical tube;

first vertical tubes of the first mounting rack and the second mounting rack as well as first vertical tubes of each two adjacent second mounting racks are connected through a first connecting tube; and second vertical tubes of the first mounting rack and the second mounting rack as well as second vertical tubes of each two adjacent second mounting racks are connected through a second connecting tube.

6. The over-the-door organizer according to claim 5, wherein adjacent ends of two adjacent first vertical tubes are sleeved on the first connecting tube, and the first connecting tube is connected to the two adjacent first vertical tubes through a first bolt; and adjacent ends of two adjacent second vertical tubes are sleeved on the second connecting tube, and the second connecting tube is connected to the two adjacent second vertical tubes through a second bolt.

7. The over-the-door organizer according to claim 5, wherein the first vertical tube and the second vertical tube are square tubes; a first side of each of the first vertical tube and the second vertical tube is provided with a plurality of mounting holes of the plurality of pairs of mounting holes at the interval;

the plurality of mounting holes on the first vertical tube and the plurality of mounting holes on the second vertical tube are arranged in pairs in one-to-one correspondence; and the over-the-door organizer comprises two hanging plates, wherein the two hanging plates are respectively connected to the first vertical tube and the second vertical tube of the first mounting rack.

8. The over-the-door organizer according to claim 7, wherein the plurality of mounting holes are slotted holes.

9. The over-the-door organizer according to claim 1, further comprising a plurality of suction cups, wherein the plurality of suction cups are arranged on the second mounting rack.

10. The over-the-door organizer according to claim 1, wherein each of the plurality of storage baskets comprises a bottom mesh and a side mesh, wherein the bottom mesh and the side mesh are connected to each other; and the pair of hooks are arranged on the side mesh.

11. The over-the-door organizer according to claim 2, wherein each of the first mounting rack and the plurality of second mounting racks comprises a first vertical tube, a second vertical tube, and a horizontal tube;

the first vertical tube and the second vertical tube are parallel to each other;

a first end of the horizontal tube is perpendicularly connected to the first vertical tube, and a second end of the horizontal tube is perpendicularly connected to the second vertical tube;

first vertical tubes of the first mounting rack and the second mounting rack as well as first vertical tubes of each two adjacent second mounting racks are connected through a first connecting tube; and second vertical tubes of the first mounting rack and the second mounting rack as well as second vertical tubes of each two adjacent second mounting racks are connected through a second connecting tube.

12. The over-the-door organizer according to claim 3, wherein each of the first mounting rack and the plurality of second mounting racks comprises a first vertical tube, a second vertical tube, and a horizontal tube;

the first vertical tube and the second vertical tube are parallel to each other;

a first end of the horizontal tube is perpendicularly connected to the first vertical tube, and a second end of the horizontal tube is perpendicularly connected to the second vertical tube;

first vertical tubes of the first mounting rack and the second mounting rack as well as first vertical tubes of each two adjacent second mounting racks are connected through a first connecting tube; and second vertical tubes of the first mounting rack and the second mounting rack as well as second vertical tubes of each two adjacent second mounting racks are connected through a second connecting tube.

13. The over-the-door organizer according to claim 4, wherein each of the first mounting rack and the plurality of second mounting racks comprises a first vertical tube, a second vertical tube, and a horizontal tube;

the first vertical tube and the second vertical tube are parallel to each other;

a first end of the horizontal tube is perpendicularly connected to the first vertical tube, and a second end of the horizontal tube is perpendicularly connected to the second vertical tube;

first vertical tubes of the first mounting rack and the second mounting rack as well as first vertical tubes of each two adjacent second mounting racks are connected through a first connecting tube; and second vertical tubes of the first mounting rack and the second mounting rack as well as second vertical tubes of each two adjacent second mounting racks are connected through a second connecting tube.

14. The over-the-door organizer according to claim 2, further comprising a plurality of suction cups, wherein the plurality of suction cups are arranged on the second mounting rack.

15. The over-the-door organizer according to claim 3, further comprising a plurality of suction cups, wherein the plurality of suction cups are arranged on the second mounting rack.

16. The over-the-door organizer according to claim 4, further comprising a plurality of suction cups, wherein the plurality of suction cups are arranged on the second mounting rack.

17. The over-the-door organizer according to claim 2, wherein each of the plurality of storage baskets comprises a bottom mesh and a side mesh, wherein the bottom mesh and the side mesh are connected to each other; and the pair of hooks are arranged on the side mesh.

18. The over-the-door organizer according to claim 3, wherein each of the plurality of storage baskets comprises a bottom mesh and a side mesh, wherein the bottom mesh and the side mesh are connected to each other; and the pair of hooks are arranged on the side mesh.

19. The over-the-door organizer according to claim 4, wherein each of the plurality of storage baskets comprises a bottom mesh and a side mesh, wherein the bottom mesh and the side mesh are connected to each other, and the pair of hooks are arranged on the side mesh.

* * * * *